US011813865B2

(12) United States Patent
Sugiura et al.

(10) Patent No.: US 11,813,865 B2
(45) Date of Patent: Nov. 14, 2023

(54) LIQUID DISCHARGING HEAD

(71) Applicant: Brother Kogyo Kabushiki Kaisha, Nagoya (JP)

(72) Inventors: Keita Sugiura, Toyokawa (JP); Jiro Yamamoto, Nagoya (JP); Shotaro Kanzaki, Handa (JP); Taisuke Mizuno, Yokkaichi (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 72 days.

(21) Appl. No.: 17/330,963

(22) Filed: May 26, 2021

(65) Prior Publication Data

US 2021/0402773 A1 Dec. 30, 2021

(30) Foreign Application Priority Data

Jun. 29, 2020 (JP) ..... 2020-111206

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/19; B41J 2/14; B41J 2/175; B41J 2/18; B41J 29/38
See application file for complete search history.

(56) References Cited

U.S. PATENT DOCUMENTS

2014/0292954 A1* 10/2014 Hirabayashi ..... B41J 2/155 347/85

FOREIGN PATENT DOCUMENTS

JP 2014-188837 A 10/2014

OTHER PUBLICATIONS

IP.com search (Year: 2022).*
"Rhombus"—Wikipedia, Introduction Section, retrieved on Jan. 27 2023 (Year: 2023).*
"Oval Shape"—Meaning, Properties, Construction, Examples, CueMath, retrieved on Jan. 27, 2023 (Year: 2023).*

* cited by examiner

*Primary Examiner* — Lisa Solomon
(74) *Attorney, Agent, or Firm* — Banner & Witcoff, Ltd.

(57) ABSTRACT

There is provided a liquid discharging head including: a pressure chamber configured to apply a pressure to a liquid so as to discharge the liquid from a nozzle; a descender arranged to overlap, in a plan view, with the nozzle and communicating the pressure chamber and the nozzle with each other; at least one return throttle channel connected to the descender; and a return manifold which communicates with the at least one return throttle channel and which is configured to receive the liquid not having been discharged from the nozzle. A cross section of the descender orthogonal to a depth direction of the descender is a non-circular shape having a major axis and a minor axis. The at least one return throttle channel is connected to at least one of a first end side of the minor axis and a second end side of the minor axis.

10 Claims, 6 Drawing Sheets

LIQUID DISCHARGING HEAD

CROSS REFERENCE TO RELATED APPLICATION

The present application claims priority from Japanese Patent Application No. 2020-111206, filed on Jun. 29, 2020, the disclosure of which is incorporated herein by reference in its entirety.

BACKGROUND

The present disclosure relates to a liquid discharging head (liquid discharge head).

A liquid discharging head provided with an ink supply channel, individual supply channels, a circulation common channel is known. Each of the individual supply channels communicates the ink supply channel with a pressure chamber. Further, a nozzle communicating channel is provided on a downstream side of the pressure chamber, and a nozzle is connected to a downstream end of the nozzle communicating channel. This nozzle communicating channel is formed to have a quadrangular shape in a plan view, and the nozzle is arranged in the center of the nozzle communicating channel.

The liquid discharging head having such a configuration is provided with one or a plurality of pieces of circulation individual channel communicating the nozzle communicating channel and the circulation common channel with each other. A liquid which has not been discharged or ejected from the nozzle is allowed to flow into the circulation common channel via the circulation individual channel.

SUMMARY

According to an aspect of the present disclosure, there is provided a liquid discharging head including:

- a pressure chamber configured to apply a pressure to a liquid so as to discharge the liquid from a nozzle;
- a descender arranged to overlap, in a plan view, with the nozzle and communicating the pressure chamber and the nozzle with each other;
- at least one return throttle channel connected to the descender; and
- a return manifold which communicates with the at least one return throttle channel and which is configured to receive the liquid not having been discharged from the nozzle,
- wherein a cross section of the descender orthogonal to a depth direction of the descender is a non-circular shape having a major axis and a minor axis; and
- the at least one return throttle channel is connected to at least one of a first end side of the minor axis and a second end side, opposite to the first end side, of the minor axis.

BRIEF DESCRIPTION OF THE DRAWINGS

FIG. 3 is a cross-sectional view taken along a III-III line in FIG. 2.

DESCRIPTION

In the conventional liquid discharging head, in such a case that any air bubble enters from the nozzle, there is such a problem that the air bubbly cannot be easily discharged or exhausted to the circulation individual channel.

In view of the above-described situation, an object of the present disclosure is to provide a liquid discharging head in which the air bubble entered from the nozzle can be easily discharged to a return throttle channel.

According to the present disclosure, the cross section of the descender is formed to have the non-circular shape, and the at least one return throttle channel is connected to at least one of the side of one end of the minor axis and the side of the other end of the minor axis. Accordingly, it is possible to make the spacing distance between the nozzle and the at least one return throttle channel to be small, as compared with a conventional liquid discharging head having a return throttle channel connected to a descender having the quadrangular shape. With this, any air bubble entered from the nozzle is easily discharged to the at least one return throttle channel soon after a pressure has been applied to the air bubble by the liquid flowing through the descender, which in turn improves a discharging performance for the air bubble. Further, since the at least one return throttle channel is connected to at least one of the side of the one end of the minor axis and the side of the other end of the minor axis, it is possible to form an area extending in a direction of the major axis in the descender. By doing so, it is possible to make the channel resistance up to the nozzle to be small.

According to the present disclosure, it is possible to provide a liquid discharging head in which the air bubble entered from the nozzle can be easily discharged to a return throttle channel.

In the following, a liquid discharging head according to an embodiment of the present invention will be explained, with reference to the drawings. The liquid discharging head to be explained below is merely an embodiment of the present invention. Therefore, the present invention is not limited to or restricted by the following embodiment; it is allowable to make any addition, deletion and change to the present disclosure, within the range not departing from the gist and spirit of the present invention.

First Embodiment

A liquid discharging apparatus 200 provided with a liquid discharging head 100 according to the present embodiment is configured, for example, to discharge (eject) a liquid such as an ink, etc.

Figure 1:
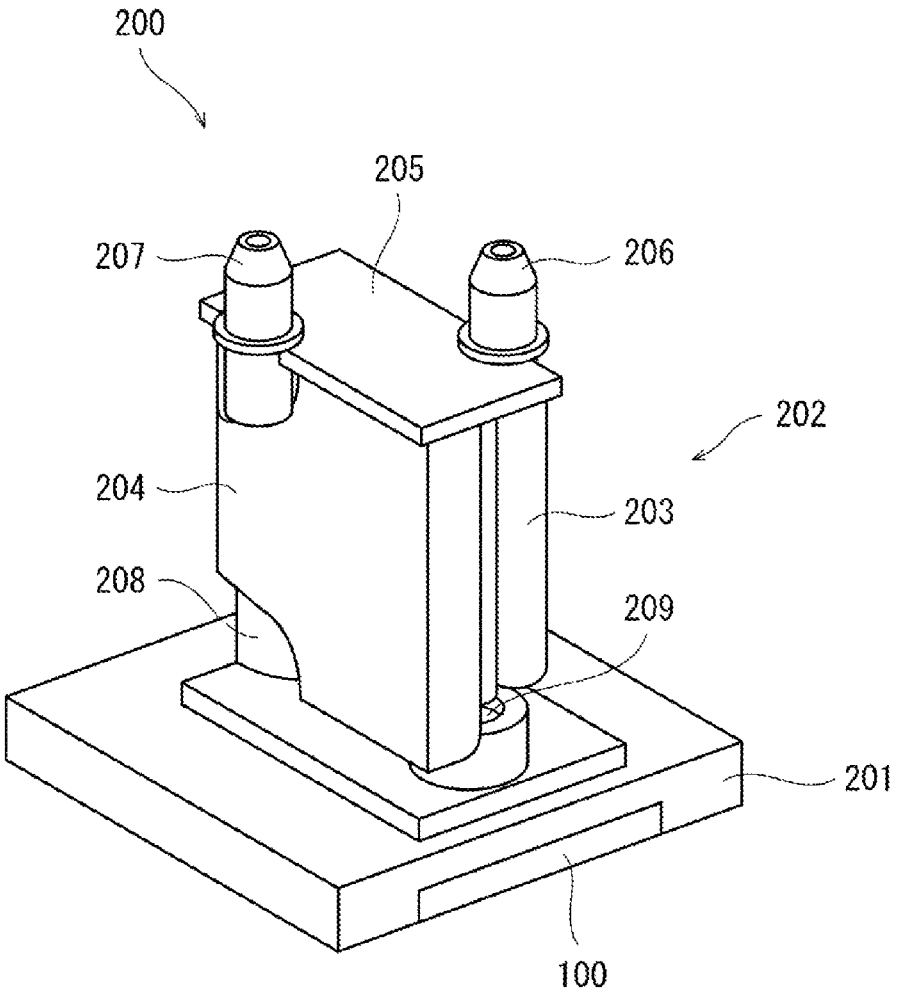
FIG. 1 is a perspective view depicting the outer appearance of a liquid discharging apparatus provided with a liquid discharging head according to an embodiment of the present disclosure.

As depicted in FIG. 1, the liquid discharging apparatus 200 of the present embodiment is provided with a head installing part 201 and a housing 202 provide on the head installing part 201. The liquid discharging head 100, which is to be described later on, is installed in the head installing part 201.

The housing 202 has sub housings 203 and 204. Upper parts of the sub housings 203 and 204 are connected to a supporting structure 205, thereby allowing the sub housings 203 and 204 to be fixed, while facing each other. Each of the sub housings 203 and 204 is formed, for example, to have a thin box shape.

The sub housing 204 has a liquid inlet port 207 at an upper part thereof, and a liquid outlet port 208 at a lower part thereof. The liquid inflowed into the sub housing 204 from the liquid inlet port 207 is filtered in the sub housing 204, and is then fed out from the liquid outlet port 208 to a channel inside the head installing part 201 (a channel connecting or linking to the liquid discharging head 100).

On the other hand, the sub housing 203 has a liquid outlet port 206 at an upper part thereof, and a liquid inlet port 209 at a lower part thereof. The liquid fed out from the channel inside the head installing part 201 enters from the liquid inlet port 209 into the inside of the sub housing 203. Then, the liquid is filtered in the sub housing 203, and is then returned to the liquid inlet port 207, from the liquid outlet port 206, by a pressure of a non-illustrated pump provided between the liquid outlet port 206 and the liquid inlet port 207, thereby allowing the liquid to be circulated.

Next, an explanation will be given about the configuration of the liquid discharging head 100 of the present embodiment, with reference to a partial plan view and a cross-sectional view, as follows.

Figure 2:
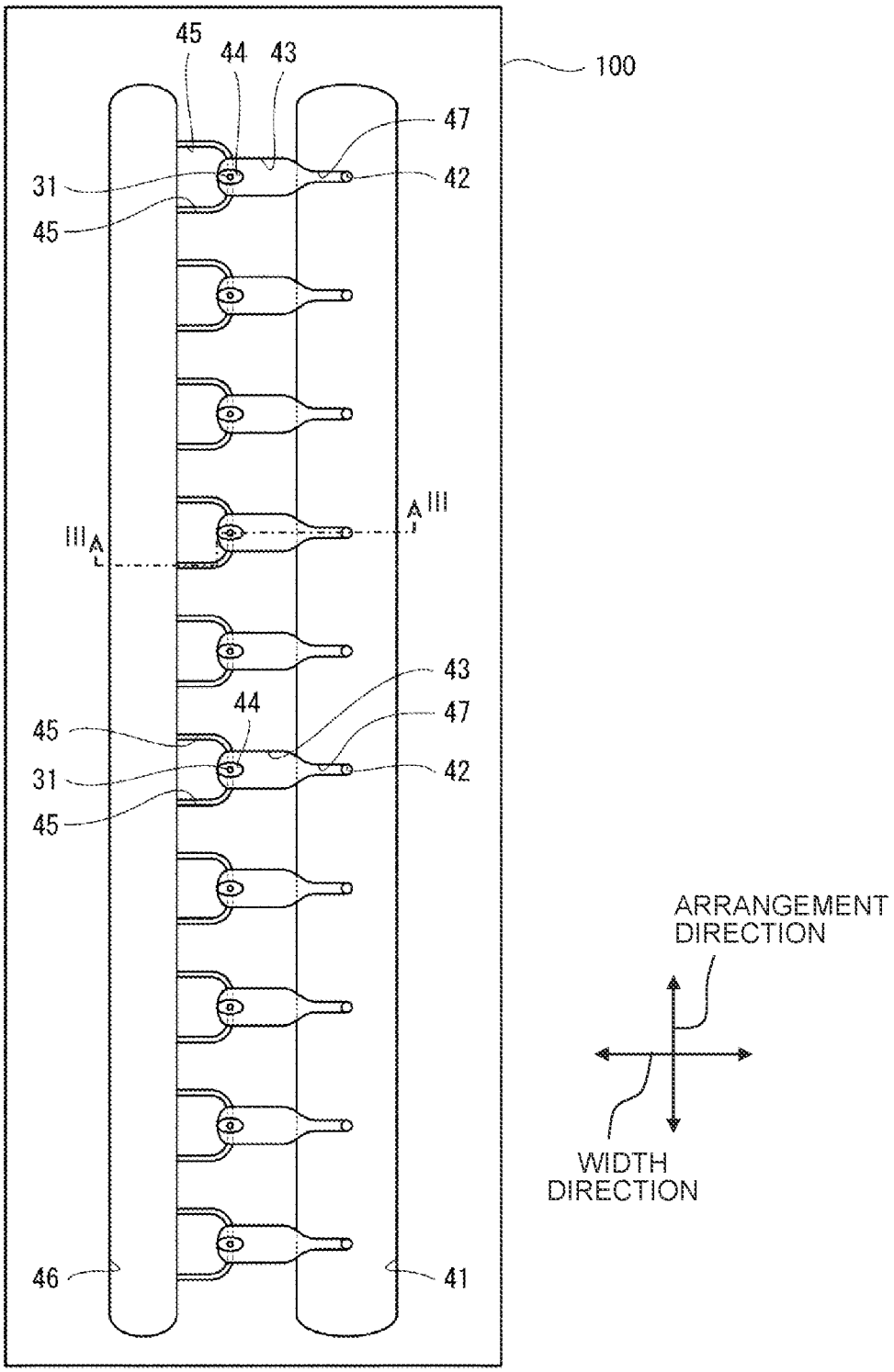
FIG. 2 is a partial plan view of the liquid discharging head of a first embodiment.

FIG. 2 is a partial plan view of the liquid discharging head 100 of the present embodiment. As depicted in FIG. 2, the liquid discharging head 100 is provided with, as a liquid channel, a supply manifold 41, communicating holes 42, supply throttle channels 47, pressure chambers 43, descenders 44, nozzles 31, return throttle channels 45 and a return manifold 46.

The supply manifold 41 and the return manifold 46 are arranged to be apart (separated) from each other in a width direction (in the present specification, this width direction is also referred to as a "left-right direction"; in this case, a side of the return manifold 46 is referred to as the left side, and a side of the supply manifold 41 is referred to as the right side"). Each of the supply manifold 41 and the return manifold 46 extends in an arrangement direction orthogonal to the width direction (in the present specification, this arrangement direction is also referred to as a "front-rear direction"). Further, the pressure chambers 43 are arranged side by side along the arrangement direction. Accordingly, the nozzles 31, which are provided corresponding to the pressure chambers 43, respectively, are also arranged side by side along the arrangement direction. Although a specific explanation will be given later on, the liquid from the supply manifold 41 is allowed to be discharged from the nozzles 31, via the communicating holes 42, the supply throttle channels 47, the pressure chambers 43 and the descenders 44. Furthermore, in the present embodiment, two pieces of the return throttle channel 45 are connected with respect to one piece of the descender 44. Note that although ten pieces of the pressure chamber 43 are depicted in FIG. 2, the number of the pressure chamber 43 is not limited to or restricted by this.

Figure 3:
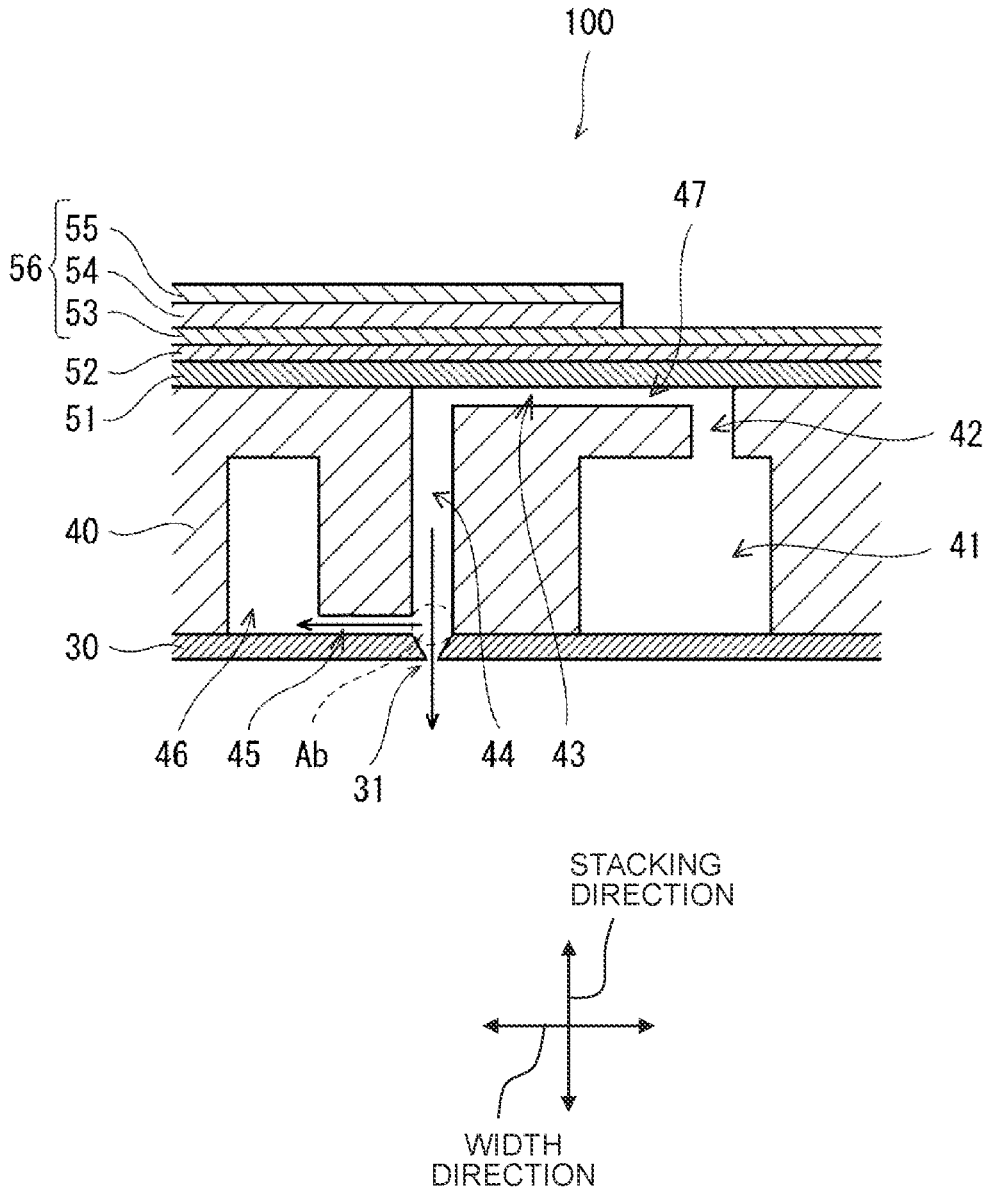
FIG. 3 is a cross-sectional view depicting the configuration of the liquid discharging head according to the first embodiment.

FIG. 3 is a cross-sectional view depicting the configuration of the liquid discharging head 100 according to the present embodiment. As depicted in FIG. 3, the liquid discharging head 100 is provided with a piezoelectric element 56, an insulating film 52, a vibration plate 51, a channel forming body 40, and a nozzle plate 30. Note that the nozzle plate 30, the channel forming body 40, the vibration plate 51, the insulating film 52 and the piezoelectric element 56 are stacked in this order.

The nozzle plate 30 is provided with the nozzles 31 having, for example, a circular shape in a plan view. The nozzles 31 are formed to penetrate through the nozzle plate 30 in a stacking direction (in the present specification, the stacking direction is referred to as an "up-down direction", as well; in this case, a side of the nozzle plate 30 is referred to as the lower side, and a side of the piezoelectric element 56 is referred to as the upper side). Note that although each of the nozzles 31 is formed by one plate which is the nozzle plate 30, each of the nozzles 31 may be formed by two or more plates.

Next, the channel forming body 40 is formed of a stacked body of a plurality of plates. Note that in FIG. 3, the illustration of the plurality of layers in the channel forming body 40 is omitted. Holes and grooves of a variety of sizes are formed in each of the plates of the channel forming body 40. The holes and grooves formed in the respective plates of the channel forming body 40 are combined so as to form the supply manifold 41, the communicating holes 42, the supply throttle channels 47, the pressure chambers 43, the descenders 44, the return throttle channels 45 and the return manifold 46, as the liquid channel.

The supply manifold 41 and the return manifold 46 each extends in the arrangement direction which is a direction orthogonal to the width direction, in a state that the supply manifold 41 and the return manifold 46 are apart (separated) from each other in the width direction of the channel forming body 40.

The liquid to be discharged from the nozzles 31 is supplied to the supply manifold 41. Note that the liquid is supplied to the supply manifold 41 from a non-illustrated supply integration channel. Also note that in FIG. 3, the cross-sectional area of the supply manifold 41 is made to be greater than the cross-sectional area of the return manifold 46, there is no limitation thereto. It is allowable to make the cross-sectional area of the supply manifold 41 to be substantially same as the cross-sectional area of the return manifold 46. In such a case, it is allowable that the supply manifold 41 and the return manifold 46 have sizes and shapes each of which are same as each other.

The communicating hole 42 is formed at a location above the supply manifold 41. The width of the communicating hole 42 is smaller than the width of the supply manifold 41. An upstream end of the communicating hole 42 is connected to the upper surface of the supply manifold 41.

The supply throttle channel 47 is formed at a location above the communicating hole 42. The supply throttle channel 47 extends in the width direction. The supply throttle channel 47 extends to the left side with respect to the communicating hole 42. An upstream end of the supply throttle channel 47 is connected to a downstream end of the communicating hole 42. Further, a length (size) in the front-rear direction (arrangement direction) of the supply throttle channel 47 is narrowed or constricted to be shorter than a length (size) in the front-rear direction of the pressure chamber 43, since the channel resistance is required to be made higher so as not to allow the liquid to flow backward from the supply throttle channel 47 to the supply manifold 41 due to deformation of the piezoelectric element 56.

The pressure chamber 43 applies a discharge pressure, for causing the liquid to be discharged from the nozzle 31, to the liquid. The pressure chamber 43 is formed on the left side with respect to the supply throttle channel 47. An upstream end of the pressure chamber 43 is connected to a downstream end of the supply throttle channel 47.

The descender 44 is formed so as to extend from an upstream end to a downstream end thereof in the stacking direction. The upstream end of the descender 44 is connected to a downstream end of the pressure chamber 43.

Further, the downstream end of the descender 44 is connected to the nozzle 31. With this, the descender 44 communicates the pressure chamber 43 and the nozzle 31 with each other. In the present embodiment, the cross-sectional area of the descender 44 may be constant in the stacking direction, or may be varied (changed) in the stacking direction. In an aspect wherein the cross-sectional area of the descender 44 is changed in the stacking direction, it is allowable that the cross-sectional area of the descender 44 may be gradually made smaller from an upper part toward a lower part in the stacking direction thereof.

The nozzle 31 is arranged so as to overlap with the descender 44 in the plan view. Namely, the nozzle 31 is arranged to overlap with the descender 44 as viewed in the stacking direction. The nozzle 31 discharges therefrom the liquid to which the discharge pressure is applied by the pressure chamber 43. Note that in FIG. 3, an air bubble entered from the nozzle 31 into the descender 44 is depicted with a reference symbol "Ab".

In the present embodiment, a plurality of pieces of the return throttle channel 45 are connected to the descender 44. Although the specific of this configuration will be described later on, two pieces of the return throttle channel 45 are connected to the descender 44. Such a return throttle channel 45 has a part extending in the width direction. An upstream end of the return throttle channel 45 is connected to the downstream end of the descender 44, and a downstream end of the return throttle channel 45 is connected to a side surface of the return manifold 46. With this, the return throttle channel 45 communicates the descender 44 and the return manifold 46 with each other.

The liquid, which has not been discharged from the nozzle(s) 31 is collected to the return manifold 46. Note that the liquid in the return manifold 46 is allowed to flow to a non-illustrated return integration channel.

The vibration plate 51 is stacked on the channel forming body 40, and covers an upper end of the pressure chamber 43.

The piezoelectric element 56 is arranged at a location above the vibration plate 51 via the insulating film 52. The piezoelectric element 56 includes a common electrode 53, a piezoelectric layer 54 and an individual electrode 55. The common electrode 53, the piezoelectric layer 54 and the individual electrode 55 are stacked in this order.

The common electrode 53 covers the entire surface of the vibration plate 51 via the insulating film 52. The piezoelectric layer 54 is provided as piezoelectric layers 54 each of which corresponds to one of the pressure chambers 43, and each of which is arranged on the common electrode 53 so as to overlap with one of the pressure chambers 43. The individual electrode 55 is provided as individual electrodes 55 each of which corresponds to one of the pressure chambers 43, and each of which is arranged on one of the piezoelectric layers 54. One piece of the individual electrode 55, the common electrode 53, and a part (active part), of the piezoelectric layer 54, which is sandwiched by the individual electrode 55 and the common electrode 53 construct one piece of the piezoelectric element 56.

Each of the individual electrodes 55 is electrically connected to anon-illustrated driver IC. The driver IC receives a control signal from a non-illustrated controller, generates a driving signal (voltage signal), and applies the driving signal to each of the individual electrodes 55. In contrast, the common electrode 53 is maintained always at the ground potential.

In such a configuration, the active part of the piezoelectric layer 54 expands and contracts in a plane direction together with the two electrodes 53 and 55, in accordance with the driving signal. Corresponding to this, the vibration plate 51 cooperates and is deformed, and changes in a direction increasing or decreasing the volume of the pressure chamber 43. With this, the discharge pressure for causing the liquid to be discharged from the nozzle 31 is applied to the pressure chamber 43.

In the liquid discharging head 100 having the above-described configuration, the liquid flows from the non-illustrated supply integration channel into the supply manifold 41. Then, the liquid flows from the supply manifold 41 into the pressure chambers 43 via the communication holes 42 and the supply throttle channels 47. Then, the liquid flows in the descenders 44 from the upstream end toward the downstream end thereof, and flows into the nozzles 31. Here, in a case that the discharge pressure is applied to the pressure chamber 43, the liquid is discharged from the nozzle 31. On the other hand, the liquid which has not been discharged from the nozzle 31 flows into the return manifold 46 via each of the return throttle channels 45. Afterwards, the liquid is allowed to flow into the non-illustrated return integration channel from the return manifold 46.

Next, an explanation will be given about the shape of the descender 44 and the shape of the return throttle channel 45 connected to the descender 44, with reference to the drawings.

Figure 4:
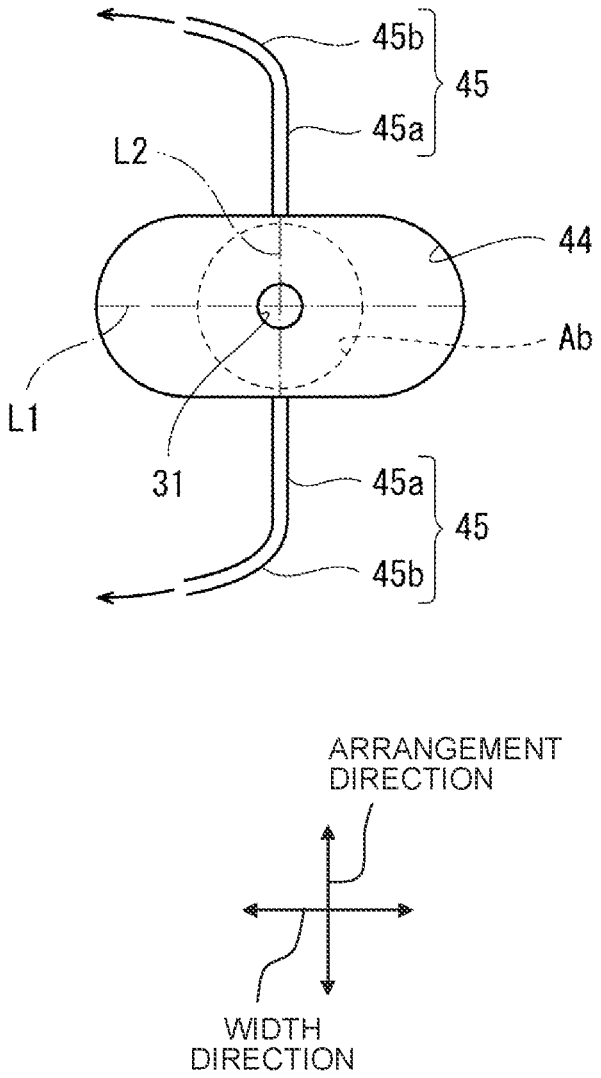
FIG. 4 is a plan view depicting a descender and a return throttle channel of the first embodiment.

FIG. 4 is a plan view depicting the descender 44 and the return throttle channel 45 in the present embodiment. Note that FIG. 4 depicts only the channel for the liquid, and illustration of parts or portions forming the channel are omitted in FIG. 4. This is similarly applicable to FIGS. 5 and 6 which will be described later on.

As depicted in FIG. 4, the descender 44 of the present embodiment is formed such that a cross section, of the descender 44, orthogonal to a depth direction (stacking direction) of the descender 44 is a non-circular shape (i.e., a shape different from a circle having a center and a circumference equidistant from the center) having a major axis L1 and a minor axis L2. Specifically, the descender 44 is formed such that the cross section is an oval shape (also referred to as a track shape, in some cases). Note that the length of the major axis L1 is, for example, in a range of 100 μm to 200 μm, and the length of the minor axis L2 is, for example, in a range of 50 μm to 100 μm.

The nozzle 31 is arranged so as to be positioned in the inside of the descender 44 in the plan view (that is, when seen in the stacking direction from the upper side). The nozzle 31 is arranged so that the center of the nozzle 31 is coincident (matches) with the point of intersection between the major axis L1 and the minor axis L2 of the descender 44, in the plan view. In this case, in the present embodiment, the diameter of the nozzle 31 is made to be shorter than the length of the minor axis L2 of the descender 44.

The above-described return throttle channels 45 are connected to a side of one end of the minor axis L2 (front side in the arrangement direction) and a side of the other end of the minor axis L2 (rear side in the arrangement direction), respectively. In the present embodiment, each of the return throttle channels 45 has a part 45*a* which is formed to have a linear shape along the arrangement direction, and a part 45*b* which is connected to a downstream end of the part 45*a* and which is bent toward the return manifold 46 in the width direction.

Since the return throttle channels 45 are connected, respectively, to the side of the one end and the side of the other end of the minor axis L2 of the descender 44, it is possible to make the distance between the nozzle 31 and each of the return throttle channels 45 connected to the descender 44 to be shorter than the conventional configuration. Owing to the above-described configuration, it is possible to make any air bubble Ab entered from the nozzle 31 to be easily discharged to each of the return throttle channels 45 soon after the pressure has been applied to the air bubble Ab by the liquid flowing through the descender 44.

As explained above, according to the liquid discharging head 100 of the present embodiment, the nozzle 31 is arranged so that the center of the nozzle 31 is coincident, in the plan view, with the point of intersection of the major axis L1 and the minor axis L2 of the cross section of the descender 44 having the oval shape. Further, the return throttle channels 45 are connected to the side of the one end and the side of the other end, respectively, of the minor axis L2 of the descender 44. With such a configuration, it is possible to make the spacing distance between the nozzle 31 and each of the return throttle channels 45 to be short, as compared with a conventional liquid discharging head having a return throttle channel connected to a descender having the quadrangular shape. With this, the air bubble Ab entered from the nozzle 31 is easily discharged to each of the return throttle channels 45 soon after the pressure has been applied to the air bubble Ab by the liquid flowing through the descender 44, which in turn improves a discharging performance for the air bubble Ab as compared with the conventional liquid discharging head. Further, the descender 44 extends in the direction of the major axis L1. Accordingly, it is possible to make the channel resistance from the pressure chamber 43 up to the nozzle 31 to be small, thereby making it possible to conduct the discharge pressure by the deformation of the piezoelectric element 56 efficiently to the nozzle 31.

Furthermore, in the present embodiment, the return throttle channel 45 is configured to have the part 45*b* which is bent, it is possible to make the channel resistance to be great in the return throttle channel 45, as compared with a return throttle channel which extends linearly toward the return manifold 46, thereby making it possible to conduct the discharge pressure by the deformation of the piezoelectric element 56 efficiently to the nozzle 31, without allowing the discharge pressure to escape greatly to the return throttle channel 45.

Second Embodiment

Next, an explanation will be given about a descender 44A and a return throttle channel 45A in a second embodiment.

Figure 5:
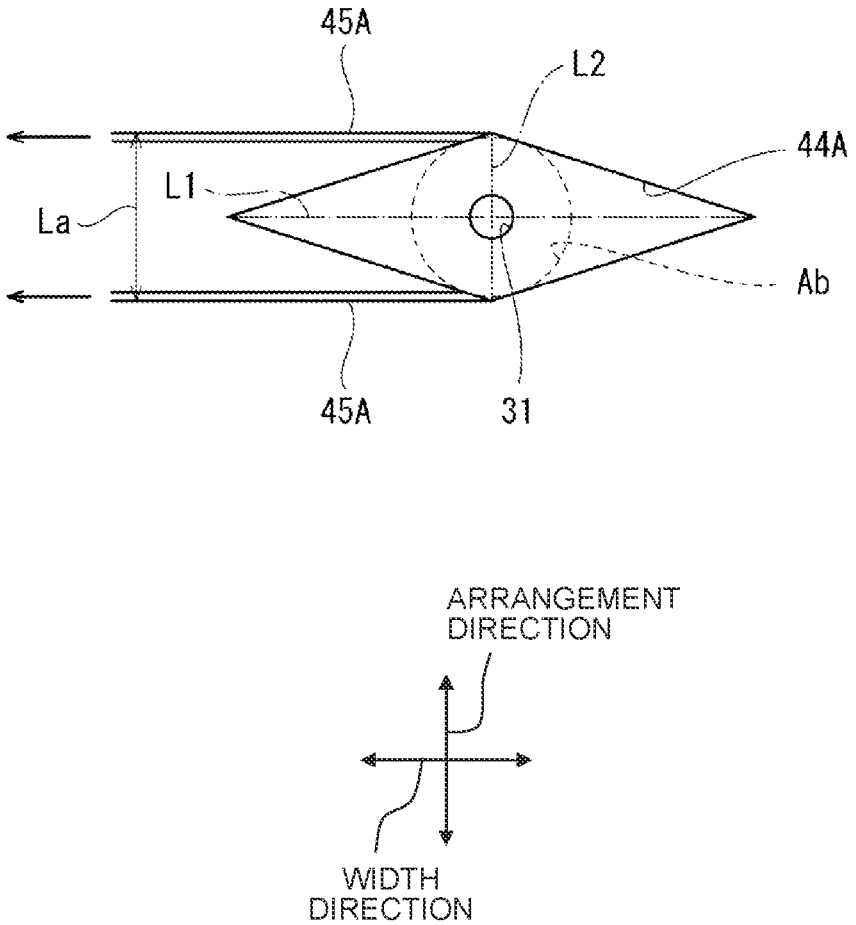
FIG. 5 is a plan view depicting a descender and a return throttle channel of a second embodiment.

As depicted in FIG. 5, the descender 44A of the second embodiment is formed such that a cross section, of the descender 44A, orthogonal to the depth direction of the descender 44A is a non-circular shape having a major axis L1 and a minor axis L2. Specifically, the cross section of the descender 44A is formed to have a rhombic shape in which the major axis L1 and the minor axis L2 are diagonal lines which are orthogonal to each other.

The nozzle 31 is arranged so as to be positioned in the inside of the descender 44A in the plan view. The nozzle 31 is arranged so that the center of the nozzle 31 is coincident (matches) with the point of intersection between the major axis L1 and the minor axis L2 of the cross section of the descender 44A, in the plan view. In this case, the diameter of the nozzle 31 is made to be shorter than the length of the minor axis L2 of the descender 44A.

The return throttle channel 45A is provided as return throttle channels 45A which are connected to a side of one end of the minor axis L2 (front side in the arrangement direction) and a side of the other end of the minor axis L2 (rear side in the arrangement direction), respectively, of the descender 44A. In the second embodiment, each of the return throttle channels 45A is formed to have a linear shape. Further, each of the return throttle channels 45A is formed to extend toward the return manifold 46 perpendicularly or orthogonally with respect to an extending direction of the return manifold 46 (namely, the arrangement direction). A length (length in the arrangement direction) La of an individual channel including the descender 44A and each of the return throttle channels 45A is, for example, approximately in a range of 50 μm to 200 μm.

As described above, since the return throttle channels 45A are connected to the side of the one end and the side of the other end of the minor axis L2 of the descender 44A, it is possible to make the distance between the nozzle 31 and each of the return throttle channels 45A connected to the descender 44A to be shorter than that in the conventional liquid discharging head. Owing to such a configuration, it is possible to make the air bubble Ab entered from the nozzle 31 into the descender 44A to be easily discharged to each of the return throttle channels 45A soon after the pressure has been applied to the air bubble Ab by the liquid flowing through the descender 44A.

As explained above, according to the second embodiment, the nozzle 31 is arranged so that the center of the nozzle 31 is coincident, in the plan view, with the point of intersection of the major axis L1 and the minor axis L2 of the cross section of the descender 44A having the rhombic shape. Further, the return throttle channels 45A are connected to the side of the one end and the side of the other end, respectively, of the minor axis L2 of the descender 44A. With such a configuration, it is possible to make the spacing distance between the nozzle 31 and each of the return throttle channels 45A to be short, as compared with the conventional liquid discharging head having a return throttle channel connected to a descender having the square shape. With this, the air bubble Ab entered from the nozzle 31 is easily discharged to each of the return throttle channels 45A soon after the pressure has been applied to the air bubble Ab by the liquid flowing through the descender 44A, which in turn improves a discharging performance for the air bubble Ab as compared with the conventional liquid discharging head. Further, the descender 44A extends in the direction of the major axis L1. Accordingly, it is possible to make the channel resistance from the pressure chamber 43 up to the nozzle 31 to be small, thereby making it possible to conduct the discharge pressure by the deformation of the piezoelectric element 56 efficiently to the nozzle 31.

Further, in the second embodiment, each of the return throttle channels 45A is formed to extend toward the return manifold 46 perpendicularly with respect to the extending direction of the return manifold 46. With this, it is possible to make the distance between descenders 44A, which are adjacent to each other, to be short. This makes it possible to realize highly densified nozzles 31.

Third Embodiment

It is also allowable to adopt a descender to be explained as follows. In the following, a descender 44B in a third embodiment will be explained.

Figure 6:
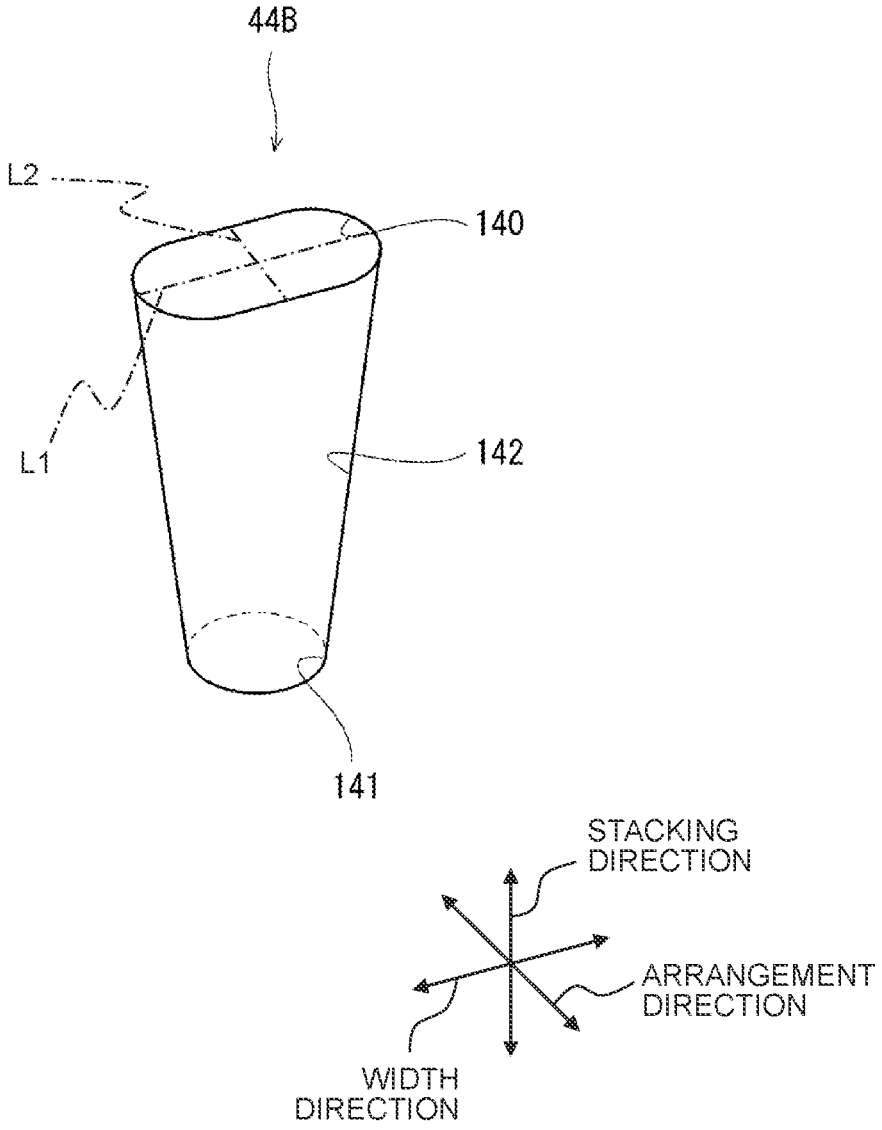
FIG. 6 is a perspective view depicting a descender of a third embodiment.

As depicted in FIG. 6, the descender 44B of the third embodiment has a first part 140 which is located on an upper side in the depth direction of the descender 44B, a second part 141 which is located on a lower side in the depth direction and an intermediate part 142 connecting or linking the first part 140 and the second part 141 with each other. A cross section of the first part 141 is formed to have an oval shape as a non-circular shape. A cross section of the second part 142 is formed to have a circular shape. The intermediate part 142 is formed by allowing the length of the major axis L1 of the first part 140 to gradually change from an upper part toward a lower part in the depth direction of the descender 44B so that the length of the major axis L1 of the first part 140 becomes, ultimately, to be substantially same with the length of the minor axis L2. Note that the return throttle channel(s) may be connected to the second part 141 of the descender 44B, and may have a shape which is same as or similar to that depicted in FIG. 4 or FIG. 5. Specifically, for example, the return throttle channel(s) is connected to the second part 141 at a side of one end of the minor axis L2 of the first part 140 and at a side of the other end of the minor axis L2 of the first part 140. Although the cross section of the second part 141 is circular, the return throttle channel(s) of the third embodiment is connected at least one of both ends sides of the minor axis L2 of the descender 44B.

According to the descender 44B of the third embodiment, the discharging property of the air bubble Ab is improved, similarly in the first and second embodiments, than that in the conventional liquid discharging head. Further, it is possible to increase the channel resistance from the upper part toward the lower part in the depth direction of the descender 44B, thereby making it possible to increase the discharging power for discharging the liquid. With this, it is possible to easily discharge also a liquid having a high viscosity.

Other Embodiments

The present invention is not limited to or restricted by the above-described embodiments, and a variety of kinds of change or modification can be made within a range not departing from the gist and spirit of the present invention, as exemplified, for example, as follows.

In the above-described embodiments, the cross section of the descender 44 is formed to have, as the non-circular shape, the oval shape including two semicircular parts and two straight parts connecting two semicircular parts. However, there is no limitation thereto. It is allowable to form the cross section of the descender 44 to have any oval shape having a rounded and elongated outline, including an elliptic shape, egg shape etc.

Further, the above-described embodiments adopt the aspect wherein the return throttle channels 45 are connected to the side of the one end (front side in the arrangement direction) and the side of the other end (rear side in the arrangement direction), respectively, of the minor axis L2 of the descender 44 (44A, 44B). The present disclosure, however, is not limited to this. It is also allowable to connect the return throttle channel 45 to at least one of the side of the one end and the side of the other end of the minor axis L2 of the descender 44 (44A, 44B).

Furthermore, in the third embodiment, the descender 44B has the first part 140 on the upper side in the depth direction of the descender 44B, and the second part 141 on the lower side in the depth direction of the descender 44B. However, there is no limitation thereto. It is also allowable that the descender 44B has the second part 141 on the upper side in the depth direction of the descender 44B, and the first part 140 on the lower side in the depth direction of the descender 44B. In such a case, the return throttle channel(s) are connected to the side of the minor axis of the first part 140 arranged at the lower side.

What is claimed is:

1. A liquid discharging head comprising:

a pressure chamber configured to apply a pressure to a liquid so as to discharge the liquid from a nozzle;

a descender arranged to overlap, in a plan view, with the nozzle and communicating the pressure chamber and the nozzle with each other;

at least one return throttle channel connected to the descender; and a return manifold which communicates with the at least one return throttle channel and which is configured to receive the liquid not having been discharged from the nozzle, wherein a cross section of the descender orthogonal to a depth direction of the descender is an oval shape having a major axis and a minor axis;

the at least one return throttle channel is connected to a first end side of the minor axis and/or a second end side, opposite to the first end side, of the minor axis; and the at least one return throttle channel extends from the descender along the minor axis and then bends toward the return manifold.

2. The liquid discharging head according to claim 1, wherein the at least one return throttle channel has a bent part.

3. The liquid discharging head according to claim 1, wherein the at least one return throttle channel extends linearly.

4. The liquid discharging head according to claim 3, wherein the at least one return throttle channel extends orthogonally to an extending direction of the return manifold.

5. The liquid discharging head according to claim 1, wherein the descender has a first part located on an upper side in the depth direction and a second part located on a lower side in the depth direction, a cross section orthogonal to the depth direction of the first part being the oval shape and a cross-section orthogonal to the depth direction of the second part being a circular shape.

6. The liquid discharging head according to claim 1, wherein the at least one return throttle channel is connected to a first end of the minor axis and/or a second end, opposite to the first end, of the minor axis.

7. A liquid discharging head comprising:

a pressure chamber configured to apply a pressure to a liquid so as to discharge the liquid from a nozzle;

a descender arranged to overlap, in a plan view, with the nozzle and communicating the pressure chamber and the nozzle with each other;

at least one return throttle channel connected to the descender; and a return manifold which communicates with the at least one return throttle channel and which is configured to receive the liquid not having been discharged from the nozzle, wherein a cross section of the descender orthogonal to a depth direction of the descender is a rhombic shape having a major axis and a minor axis, the major axis and the minor axis being diagonal lines, of the rhombic shape, orthogonal to each other;

the at least one return throttle channel is connected to a first end side of the minor axis and/or a second end side, opposite to the first end side, of the minor axis;

the at least one return throttle channel extends linearly along the major axis; and the at least one return throttle channel includes a throttle channel extending linearly, along the major axis, from one end of the minor axis to the return manifold.

8. The liquid discharging head according to claim 7, wherein the at least one return throttle channel extends orthogonally to an extending direction of the return manifold.

9. The liquid discharging head according to claim 7, wherein the descender has a first part located on an upper side in the depth direction and a second part located on a lower side in the depth direction, a cross section orthogonal to the depth direction of the first part being the rhombic shape and a cross-section orthogonal to the depth direction of the second part being a circular shape.

10. The liquid discharging head according to claim 7, wherein the at least one return throttle channel is connected to a first end of the minor axis and/or a second end, opposite to the first end, of the minor axis.

* * * * *